US010597277B2

(12) United States Patent
Fogg et al.

(10) Patent No.: US 10,597,277 B2
(45) Date of Patent: Mar. 24, 2020

(54) FILL VALVE ASSEMBLY FOR FILLER DEVICE AND ASSOCIATED METHOD OF USE

(71) Applicants: Michael Fogg, Holland, MI (US); Lon Eding, Zeeland, MI (US)

(72) Inventors: Michael Fogg, Holland, MI (US); Lon Eding, Zeeland, MI (US)

(73) Assignee: Fogg Filler Company, Holland, MI (US)

( * ) Notice: Subject to any disclaimer, the term of this patent is extended or adjusted under 35 U.S.C. 154(b) by 0 days.

(21) Appl. No.: 14/148,958

(22) Filed: Jan. 7, 2014

(65) Prior Publication Data

US 2014/0158253 A1 Jun. 12, 2014

Related U.S. Application Data

(63) Continuation-in-part of application No. 13/543,909, filed on Jul. 9, 2012, now abandoned.

(60) Provisional application No. 61/505,751, filed on Jul. 8, 2011.

(51) Int. Cl.
*B67C 3/26* (2006.01)
*B67D 7/42* (2010.01)

(52) U.S. Cl.
CPC ..... *B67C 3/26* (2013.01); *B67D 7/42* (2013.01); *B67C 2003/2602* (2013.01)

(58) Field of Classification Search
CPC . B67C 3/2637; B67C 3/26; B67C 2003/2602; B67C 3/2608; B67C 2003/2651; B67D 7/42
USPC ..... 141/59, 275, 292, 295, 353
See application file for complete search history.

(56) References Cited

U.S. PATENT DOCUMENTS

| | | | | | |
|---|---|---|---|---|---|
| 1,531,794 | A | * | 3/1925 | Larsen | 141/295 |
| 1,550,726 | A | * | 8/1925 | Larsen | 141/295 |
| 1,927,505 | A | * | 9/1933 | Salsbury | 141/292 |
| 2,168,380 | A | * | 8/1939 | Winton | 141/250 |
| 2,197,368 | A | | 4/1940 | Minard | |
| 2,197,588 | A | * | 4/1940 | Namur | B67C 3/2637 141/294 |
| 2,324,793 | A | | 7/1943 | Minard | |
| 2,478,790 | A | | 8/1949 | Stephens | |
| 2,621,845 | A | * | 12/1952 | Meyer | 251/120 |
| 2,645,401 | A | * | 7/1953 | Kerr | B67C 3/2637 141/117 |
| 2,716,517 | A | | 8/1955 | Tollberg | |
| 2,722,402 | A | | 11/1955 | Crookston | |
| 2,746,663 | A | * | 5/1956 | Day et al. | 141/59 |
| 2,761,606 | A | * | 9/1956 | Pahl et al. | 141/140 |

(Continued)

FOREIGN PATENT DOCUMENTS

GB 448756 6/1936

*Primary Examiner* — Andrew D StClair
(74) *Attorney, Agent, or Firm* — King & Partners, PLC

(57) ABSTRACT

A fill valve assembly for use in association with a filler device including: a vent tube; a valve housing; a valve sleeve; and a quick start seal member, wherein: (1) the vent tube is positioned at least partially within the valve housing and the valve sleeve, (2) the valve housing is in communication with the filler device, (3) the valve sleeve is positioned at least partially within the valve housing, (4) the quick start seal member is positioned within the valve housing; and (5) the fill valve assembly is configured for precluding filling start lag during normal operation of the filler device.

1 Claim, 10 Drawing Sheets

(56) References Cited

U.S. PATENT DOCUMENTS

| | | | | | |
|---|---|---|---|---|---|
| 2,913,016 | A | * | 11/1959 | Luther | 141/7 |
| 3,160,183 | A | | 12/1964 | Franz | |
| 3,175,591 | A | | 3/1965 | Manas | |
| 3,263,711 | A | * | 8/1966 | Laub | 141/40 |
| 3,289,712 | A | | 12/1966 | Smith | |
| 3,334,668 | A | * | 8/1967 | Allen | 141/292 |
| 3,430,639 | A | | 3/1969 | Roberts | |
| 3,474,835 | A | | 10/1969 | Nicholls | |
| 3,530,906 | A | | 9/1970 | Wright | |
| 3,530,928 | A | | 9/1970 | Swinney | |
| 3,568,734 | A | | 3/1971 | Drake et al. | |
| 3,578,038 | A | | 5/1971 | Burford | |
| 3,756,290 | A | * | 9/1973 | Cleland et al. | 141/5 |
| 3,774,658 | A | | 11/1973 | Abramoaka, Jr. | |
| 3,871,425 | A | | 3/1975 | Fee et al. | |
| 3,892,264 | A | | 7/1975 | Held | |
| 3,926,229 | A | | 12/1975 | Scholle | |
| 4,084,626 | A | * | 4/1978 | King | 141/7 |
| 4,089,353 | A | * | 5/1978 | Antonelli | 141/302 |
| 4,136,851 | A | | 1/1979 | Hansen et al. | |
| 4,219,054 | A | | 8/1980 | Carter et al. | |
| 4,269,236 | A | * | 5/1981 | Fogg | 141/293 |
| 4,437,498 | A | | 3/1984 | Pankratz et al. | |
| 4,567,919 | A | | 2/1986 | Fogg et al. | |
| 4,615,354 | A | | 10/1986 | Bianchi | |
| 4,848,381 | A | | 7/1989 | Livingston et al. | |
| 4,960,296 | A | | 10/1990 | Thelen et al. | |
| 5,037,141 | A | | 8/1991 | Jardine | |
| 5,058,632 | A | * | 10/1991 | Lawarre et al. | 141/39 |
| 5,083,593 | A | * | 1/1992 | Fogg | 141/295 |
| 5,085,255 | A | * | 2/1992 | LaWarre et al. | 141/39 |
| 5,275,216 | A | | 1/1994 | Haedt | |
| 5,402,833 | A | | 4/1995 | Cluserath | |
| 5,450,882 | A | | 9/1995 | Cragun | |
| 5,531,253 | A | | 7/1996 | Nishiyama et al. | |
| 5,533,552 | A | | 7/1996 | Ahiers | |
| 5,690,151 | A | | 11/1997 | Ruttier et al. | |
| 5,740,844 | A | | 4/1998 | Miller | |
| 5,845,683 | A | | 12/1998 | Sundby et al. | |
| 5,865,221 | A | | 2/1999 | Ludwig et al. | |
| 5,878,992 | A | | 3/1999 | Edwards et al. | |
| 5,975,159 | A | | 11/1999 | Persenaire et al. | |
| 6,076,567 | A | * | 6/2000 | Naecker et al. | 141/59 |
| 6,152,195 | A | | 11/2000 | Persenaire | |
| 6,253,811 | B1 | | 7/2001 | Slagh | |
| 6,305,437 | B1 | | 10/2001 | Edwards et al. | |
| 6,338,370 | B1 | * | 1/2002 | Edwards et al. | 141/90 |
| 6,508,046 | B1 | | 1/2003 | Resterhouse et al. | |
| 6,655,109 | B2 | | 12/2003 | Resterhouse et al. | |
| 6,725,633 | B2 | | 4/2004 | Resterhouse | |
| 6,786,248 | B2 | | 9/2004 | Johnson et al. | |
| 6,810,636 | B2 | | 11/2004 | Resterhouse | |
| 6,889,482 | B2 | | 5/2005 | Edwards et al. | |
| 7,753,093 | B2 | * | 7/2010 | Jenne | 141/287 |
| 8,496,031 | B2 | * | 7/2013 | Jenne | 141/286 |
| 8,834,788 | B2 | | 9/2014 | Fogg et al. | |
| 8,915,270 | B2 | | 12/2014 | Fogg | |
| 9,120,665 | B1 | | 9/2015 | Fogg et al. | |
| 9,388,036 | B2 | | 7/2016 | Fogg et al. | |
| 9,475,688 | B2 | | 10/2016 | Fogg | |
| 9,810,307 | B2 | | 11/2017 | Fogg et al. | |
| 9,908,066 | B2 | | 3/2018 | Kemme et al. | |
| 10,233,067 | B2 | | 3/2019 | Fogg et al. | |
| 10,246,269 | B2 | | 4/2019 | Rillema et al. | |
| 2010/0224262 | A1 | * | 9/2010 | Arnalsteen et al. | 137/43 |

* cited by examiner

FILL VALVE ASSEMBLY FOR FILLER DEVICE AND ASSOCIATED METHOD OF USE

CROSS-REFERENCE TO RELATED APPLICATIONS

This application is a continuation-in-part of U.S. application Ser. No. 13/543,909, filed Jul. 9, 2012, entitled "Fill Valve Assembly for Filler Device," which claims the benefit of U.S. Provisional Application Ser. No. 61/505,751, filed Jul. 8, 2011, entitled "Fill Valve Assembly for Filler Device," which are hereby incorporated herein by reference in their entirety—including all references cited therein.

BACKGROUND OF THE INVENTION

1. Field of the Invention

The present invention relates in general to a fill valve assembly, and more particularly, to a quick start fill valve assembly for use in association with a filler device having a displaceable internal seal member. Such a quick start fill valve assembly is especially beneficial for filling small volume containers (e.g., less than approximately 32 ounces) with fill material or product (e.g., flowable solids, liquids such as water, juice, soda, milk, yogurt, condiments, etcetera), as well as when filling parameters require the use of what the industry considers small diameter valves (e.g., less than approximately three quarters of an inch).

2. Background Art

Fill valve assemblies for use in association with filler devices have been known in the art for years and are the subject of numerous patents, including: U.S. Pat. No. 6,786,248 entitled "Fill Valve Assembly for Filler Device;" U.S. Pat. No. 6,338,370 entitled "Fill Valve Assembly for Filler Device and Associated Method;" U.S. Pat. No. 5,845,683 entitled "Method and Apparatus for Cleaning a Fill Pipe of a Liquid Packaging Machine;" U.S. Pat. No. 5,740,844 entitled "Fill System Including a Fill Valve Housing with Interchangeable Sanitary Cover and Clean-in-Place Manifold;" U.S. Pat. No. 5,690,151 entitled "Dual Channel Bag Filling Machine with a Clean-in-Place System that Cleans One Channel While the Other Continues to Fill Bags;" U.S. Pat. No. 5,533,552 entitled "Bottle Filling Machine and a Cleansing System Accessory Including an Operator Therefor;" U.S. Pat. No. 5,531,253 entitled "Powder Filling Apparatus and a Method for Filling a Container with Powder;" U.S. Pat. No. 5,450,882 entitled "Beverage Dispensing Apparatus and Process;" U.S. Pat. No. 5,402,833 entitled "Apparatus for Filling Bottles for Similar Containers;" U.S. Pat. No. 4,848,381 entitled "Clean in Place System;" U.S. Pat. No. 4,437,498 entitled "Carton Filling Apparatus;" U.S. Pat. No. 4,219,054 entitled "Method and Apparatus for Filling Valve Bags;" U.S. Pat. No. 3,774,658 entitled "Vent Tube with Slidable Spreader for Filling Containers;" U.S. Pat. No. 3,568,734 entitled "Carton-Filling Apparatus;" and U.S. Pat. No. 3,430,639 entitled "Cleaning Means for Liquid Dispensers;" all of which are hereby incorporated herein by reference in their entirety—including all references cited therein. While fill valve assemblies for use in association with filler devices are commercially available, problems associated with filling start lag (i.e., slow start or clearing of the vent tube) remain largely problematic, especially when: (1) the fill valve assembly is being used for filling small containers; (2) the fill valve assembly is being used for filling a container with a viscous product regardless of size; and/or (3) filling parameters require the use of small diameter valves. Notably, under what are becoming more and more common container sizes and valve diameter configurations in the industry, filling start lag or pause to start the filling process can range from a few seconds to several seconds—both of which are typically unacceptable to the customer due to the high production output expectations and/or requirements. Notably, current technology filler devices for beverage bottles, containers, and packages are expected to fill tens and up to hundreds of units per minute. As such, any start lag, pause, or delay in filling can be extremely problematic.

It is therefore an object of the present invention to provide a quick start fill valve for use in association with a filler device which remedies the detriments and/or complications associated with conventional fill valve assemblies known in the art.

It is therefore a further object of the present invention to provide a quick start fill valve for use in association with a filler device which is free or substantially free from product fill start lag via incorporation of a displaceable internal seal member.

These and other objects of the present invention will become apparent in light of the present specification, claims, and drawings.

SUMMARY OF THE INVENTION

The present invention is directed to, in one embodiment, a fill valve assembly for use in association with a filler device comprising: a vent tube, a valve housing, a valve sleeve, and a quick start seal member; wherein the vent tube is positioned at least partially within the valve housing and the valve sleeve; and wherein the valve housing is in communication with the filler device; and further wherein the valve sleeve is positioned at least partially within the valve housing; and yet further wherein the quick start seal member is positioned within the valve housing; and means for precluding filling start lag during normal operation of the filling device.

In a preferred embodiment of the present invention, the filling start lag preclusion means comprises the quick start seal member being displaceable along the vent tube within the valve housing.

In another preferred embodiment of the present invention, the quick start seal member comprises a density less than that of the fill material or product that it is filling. In this embodiment, displacement and/or vertical movement of the valve sleeve is not required to raise and seal the quick start seal member because it is already properly positioned against the inner top surface of the valve housing due to its lighter density differential relative to the fill material or product.

In yet another preferred embodiment of the present invention, when the fill valve assembly is in a first open position, the quick start seal member contacts an upper wall of the valve housing, and when the fill valve assembly is in a second open position, the quick start seal member contacts a lower displacement stop member of the vent tube.

The present invention is also directed to, in one embodiment, a fill valve assembly for use in association with a filler device comprising: a vent tube, a valve housing, a valve sleeve, and a quick start seal member; wherein the vent tube is positioned at least partially within the valve housing and the valve sleeve; and wherein the valve housing is in communication with the filler device; and further wherein the valve sleeve is positioned at least partially within the valve housing; and yet further wherein the quick start seal member is positioned within the valve housing; and additionally wherein the fill valve assembly is positionable among a closed position, a first open position, a second open position, and a clean-in-place position.

The present invention is further directed to, in one embodiment, a fill valve assembly for use in association with a filler device, comprising: a vent tube, a valve housing, a valve sleeve, and a quick start seal member; wherein the vent tube is positioned at least partially within the valve housing, and the valve sleeve; and wherein the valve housing is in communication with the filler device; and further wherein the valve sleeve is positioned at least partially within the valve housing; and yet further wherein the quick start seal member is positioned within the valve housing; and additionally wherein the fill valve assembly is positionable among a closed position, a first open position, a second open position, and a clean-in-place position; wherein when in the closed position: (1) a lower surface the quick start seal member contacts an upper surface of a stop member of the vent tube; (2) an intermediate seal member sealingly engages an outer surface of the valve sleeve and an inner surface of the valve housing; and (3) a lower seal member sealingly engages a lower end of the vent tube and an inner surface of the valve sleeve; wherein when in the first open position: (1) an upper surface of the quick start seal member contacts an inner top surface of the valve housing; (2) the intermediate seal member sealingly engages the outer surface of the valve sleeve and the inner surface of the valve housing; and (3) the lower seal member disengages the seal between the lower end of the vent tube and the inner surface of the valve sleeve; wherein when in the second position: (1) the lower surface of the quick start seal member contacts the upper surface of the stop member of the vent tube; (2) the intermediate seal member sealingly engages the outer surface of the valve sleeve and the inner surface of the valve housing; and (3) the lower seal member disengages the seal between the lower end of the vent tube and the inner surface of the valve sleeve; and wherein when in the clean-in-place (CIP) position: (1) the lower surface of the quick start seal member contacts the upper surface of the stop member of the vent tube; (2) the intermediate seal member disengages the seal between at least a portion of the outer surface of the valve sleeve and the inner surface of the valve housing; and (3) the lower seal member disengages the seal between the lower end of the vent tube and the inner surface of the valve sleeve.

BRIEF DESCRIPTION OF THE DRAWINGS

The invention will now be described with reference to the drawings wherein.

DETAILED DESCRIPTION OF THE INVENTION

Figure 1B:
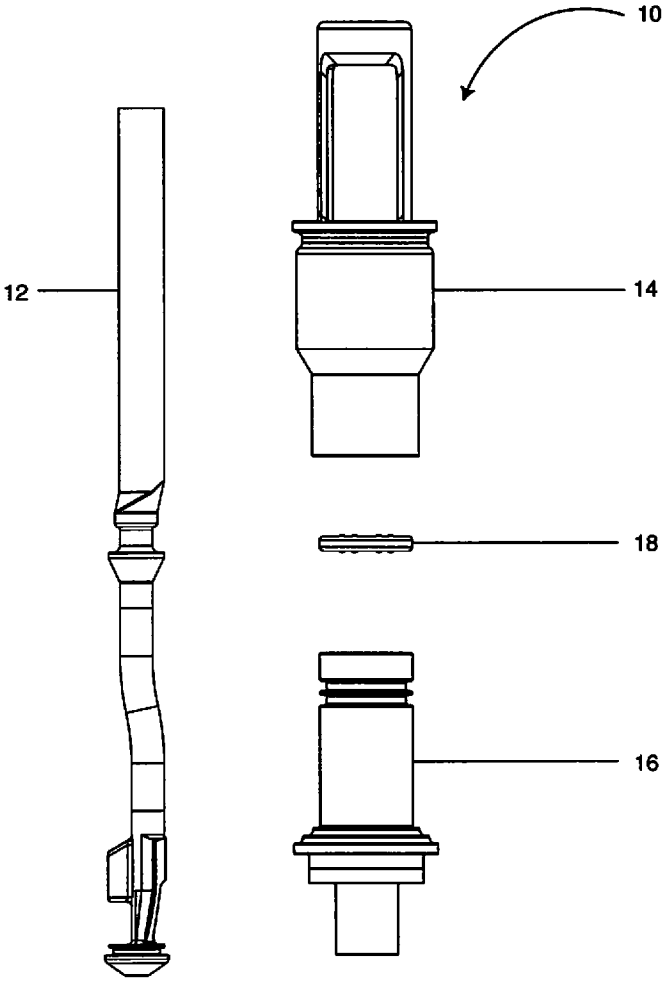
FIG. 1B of the drawings is an exploded perspective view of a fill valve assembly fabricated in accordance with the present invention.

While this invention is susceptible of embodiment in many different forms, there is shown in the drawings and will be described in detail, one or more specific embodiments with the understanding that the present disclosure is to be considered as an exemplification of the principles of the invention and is not intended to limit the invention to the embodiment illustrated.

It will be understood that like or analogous elements and/or components, referred to herein, are identified throughout the drawings by like reference characters. In addition, it will be understood that the drawings are merely schematic representations of an embodiment of the invention, and some of the components may have been distorted from their actual scale for purposes of pictorial clarity.

Figure 1A:
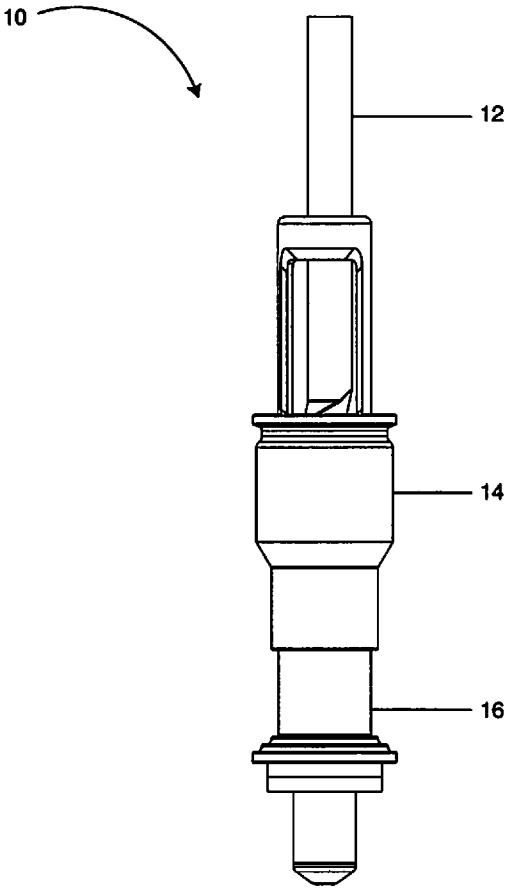
FIG. 1A of the drawings is an assembled perspective view of a fill valve assembly fabricated in accordance with the present invention.

Referring now to the drawings, and to FIGS. 1A and 1B in particular, fill valve assembly 10 is shown, which generally comprises vent tube 12, valve housing 14, valve sleeve 16, and quick start seal member 18 (FIG. 1B only). Fill valve assembly 10 is intended for use in association with filler devices, which are generally capable of filling associated containers and/or bags with any one of a number of fill materials. Such filler devices may comprise linear filler devices, rotary filler devices and other devices which are capable of filling containers, bottles, and/or packages with fill material and/or product.

In accordance with one embodiment of the present invention, fill valve assembly 10 comprises a quick start fill valve assembly for use in association with a filler device which is free or substantially free from product fill start lag via cooperative association of internal, quick start seal member 18 therewith. As will be discussed in greater detail infra, fill valve assembly 10 is capable of four distinct positions, namely: (1) a closed position (See FIG. 6B); (2) a first open position wherein the quick start seal member contacts an upper wall of the valve housing (See FIG. 7B); (3) a second open position wherein the quick start seal member contacts a lower displacement stop member of the vent tube (See FIG. 8B); and (4) a CIP position (See FIG. 9B).

Figure 2:
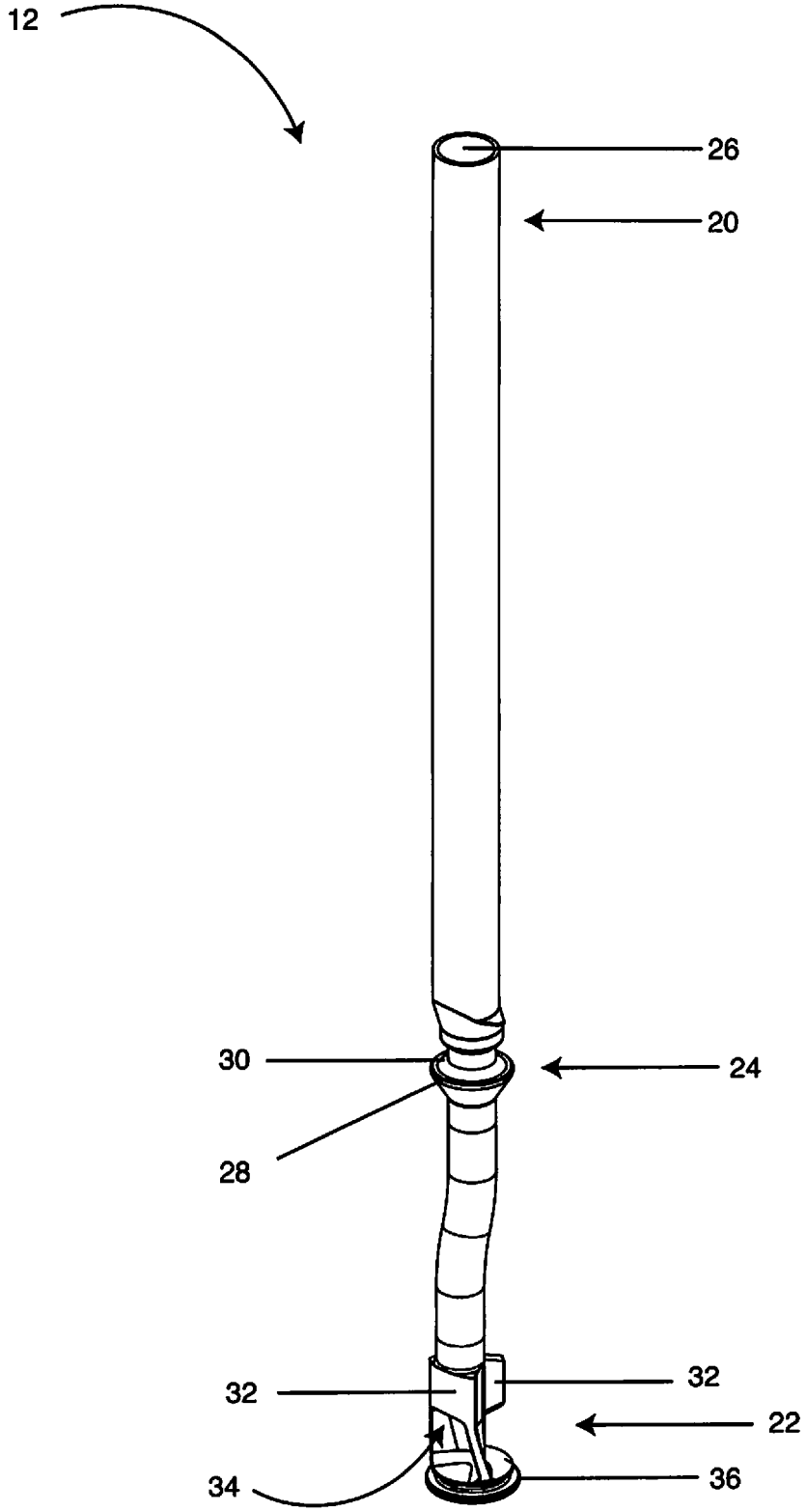
FIG. 2 of the drawings is a perspective view of a vent tube fabricated in accordance with the present invention.

Referring now to FIGS. 1A and 2, vent tube 12 is positioned generally within both valve housing 14 and valve sleeve 16, and includes upper end 20, lower end 22, and intermediate region 24 positioned between upper and lower ends 20 and 22, respectively. Upper end 20 includes upper venting aperture 26 which is in communication with the reservoir of an associated filler device. Intermediate region 24 includes stop member 28 having generally annular upper surface 30. It will be understood that during normal operation stop member 28 regulates the lower displacement of quick start seal member 18. Lower end 22 includes alignment tabs 32, lower venting aperture 34, and lower seal member 36 which comprises an O-ring (not shown for pictorial clarity) seated in an annular channel.

Figure 3:
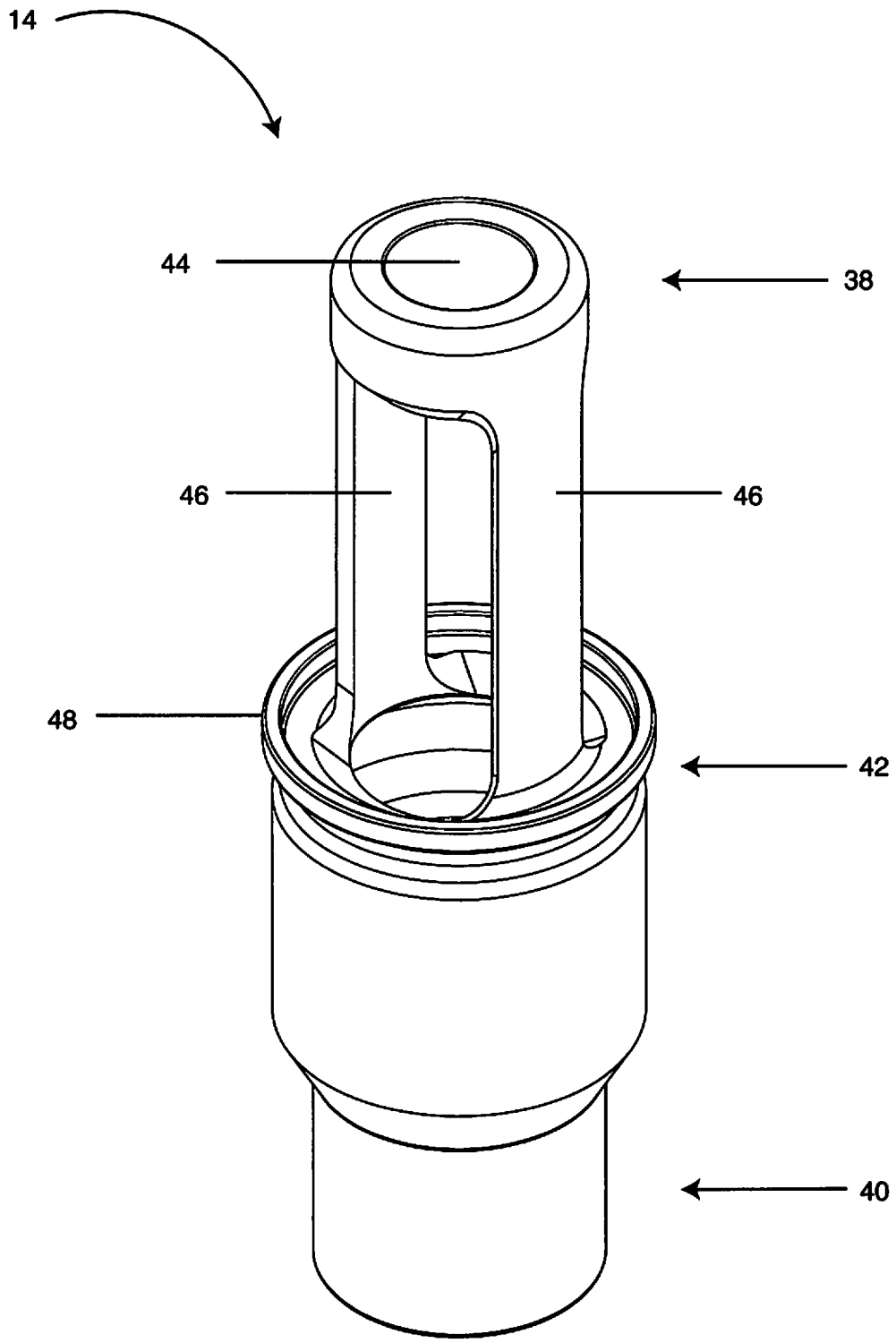
FIG. 3 of the drawings is a perspective view of a valve housing fabricated in accordance with the present invention.

As is best shown in FIGS. 1A and 3, valve housing 14 (e.g., a valve adapter, etcetera) is associated with filler device 80 (See FIGS. 6B, 7B, 8B, and 9B) on one end and valve sleeve 16 on the other end. More specifically, valve housing 14 includes upper end 38, lower end 40, and intermediate region 42 positioned between upper and lower ends 38 and 40, respectively. Upper end 38 includes vent tube alignment aperture 44 and upper stop members 46. Intermediate region 42 includes generally annular flange 48 which, in cooperation with a clamp (not shown), facilitates releasable securement to associated filler device 80. As is best shown in FIGS. 6B, 7B, 8B, and 9B, it will be understood that during normal operation inner surface 41 of lower end 40 of valve housing 14 is in communication with the outer surface 51 of valve sleeve 16.

Figure 4:
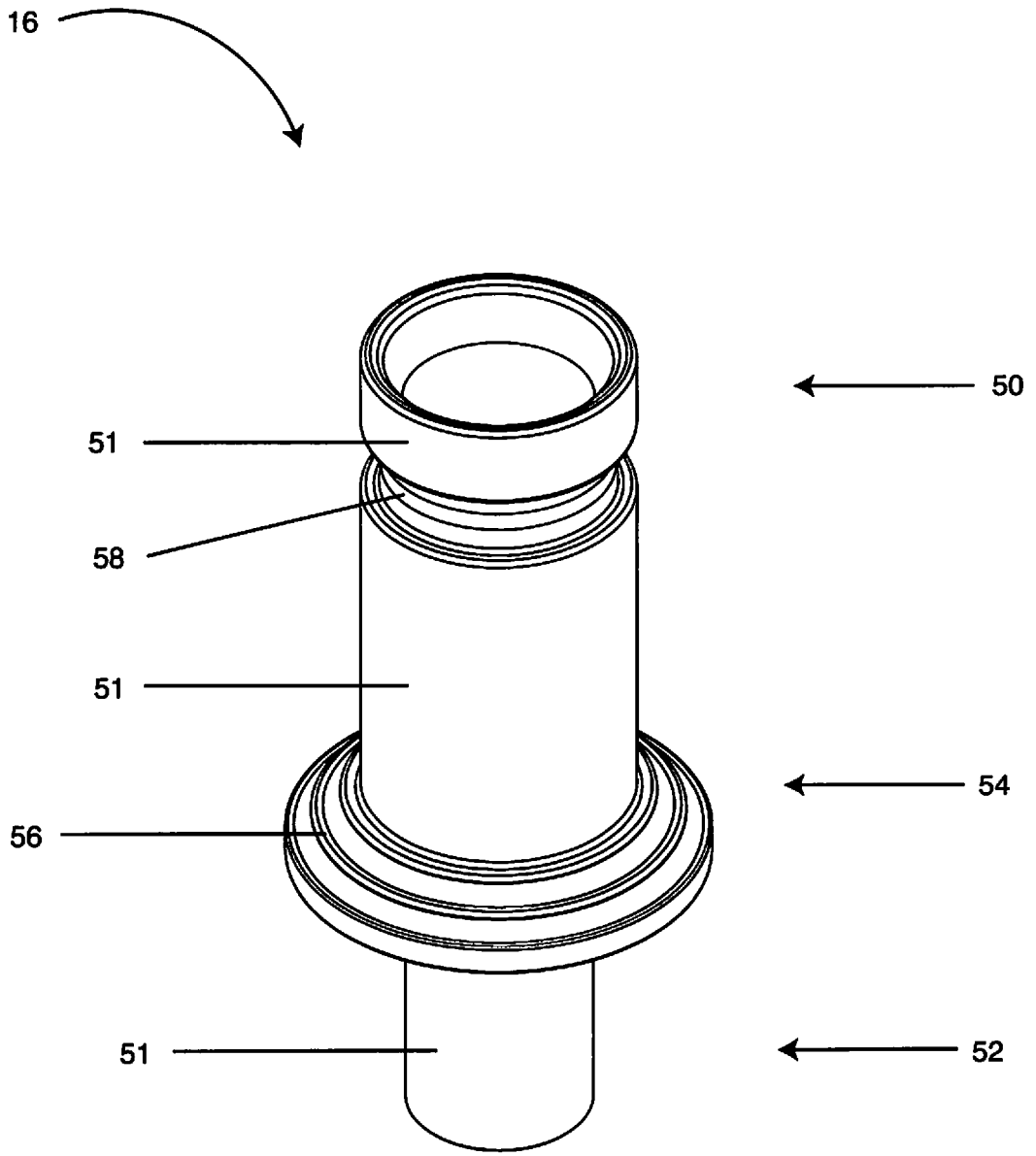
FIG. 4 of the drawings is a perspective view of a valve sleeve fabricated in accordance with the present invention.

Referring now to FIGS. 1A and 4, valve sleeve 16 is positioned both generally below and partially within valve housing 14, and includes upper end 50, lower end 52, and intermediate region 54 positioned between upper and lower ends 50 and 52, respectively. Valve sleeve 16 includes outer surface 51 and generally annular channel 58 for containing a seal member such as a flip-flop seal (See U.S. Pat. No. 5,083,593), an O-ring, etcetera. Intermediate region 54 includes a plurality of generally annular flanges 56 for containing a conventional compression spring (not shown).

Figure 5A:
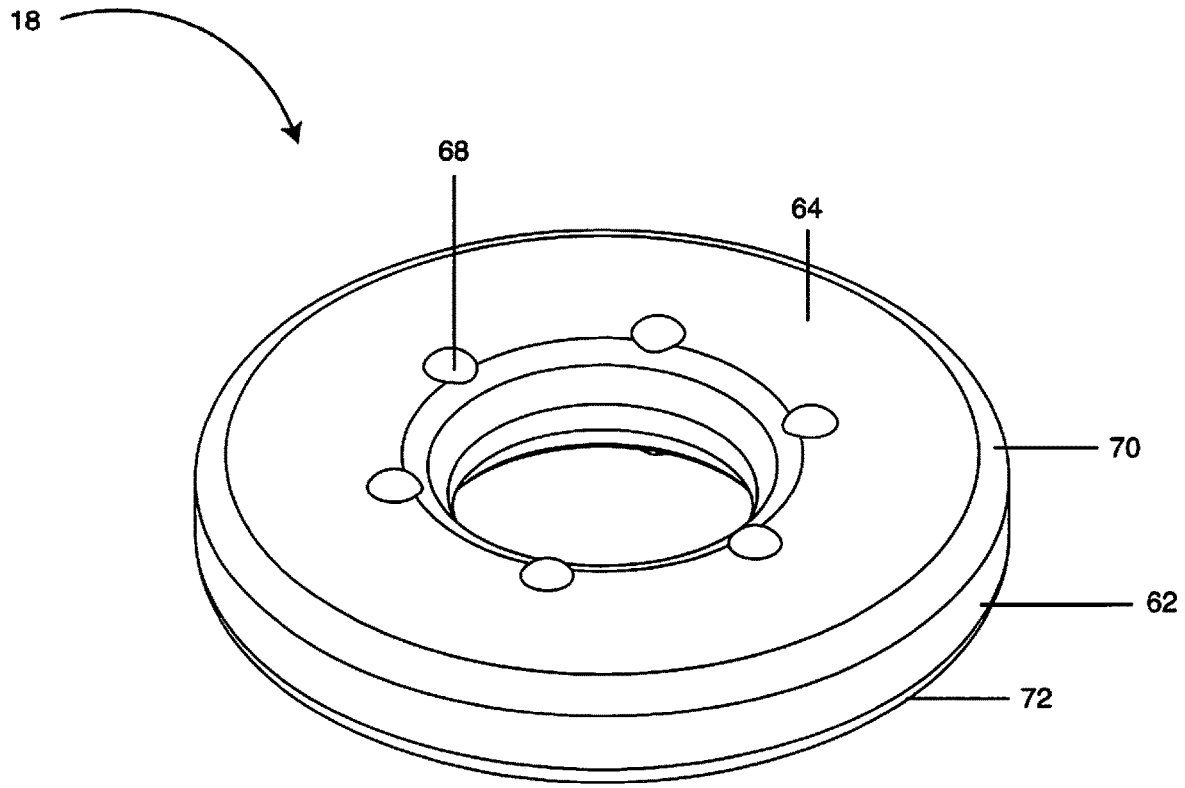
FIG. 5A of the drawings is a perspective view of a seal member fabricated in accordance with the present invention.
Figure 5B:
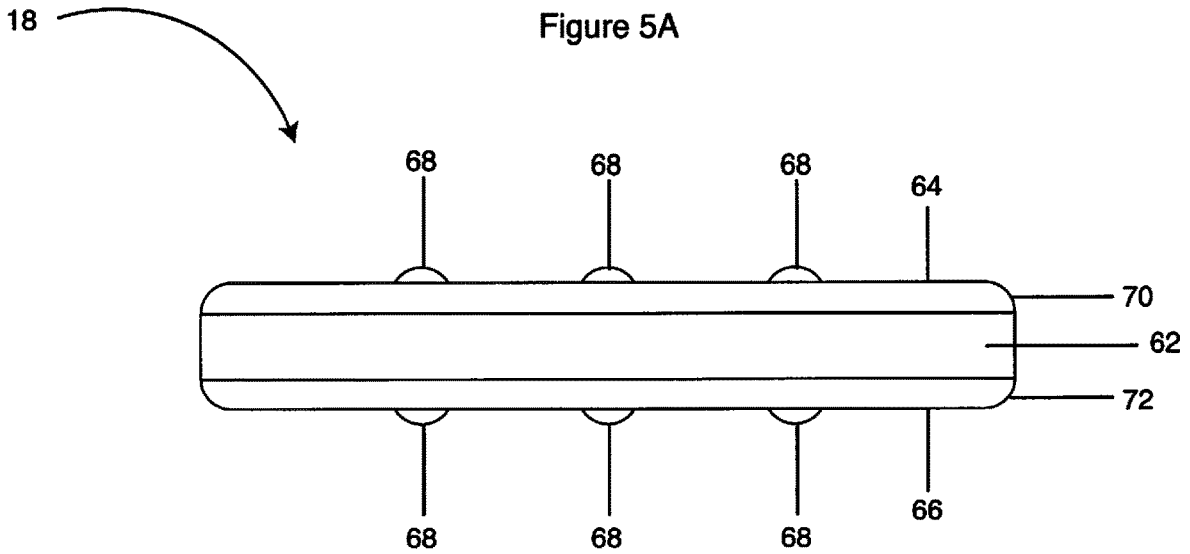
FIG. 5B of the drawings is a side elevational view of a seal member fabricated in accordance with the present invention.

As is best shown in FIGS. 5A and 5B quick start seal member 18 includes body 62, upper surface 64, lower surface 66, and optionally a plurality of protrusions 68 positioned on upper and lower surfaces 64 and 66, respectively. It will be understood that protrusions 68 facilitate easy cleaning, as well as substantially reduce the likelihood that seal member 18 will stick to a surface (e.g., annular upper surface 30 of stop member 28) after non-use for a period of time. In one embodiment protrusions 68 are circumferentially evenly spaced apart from one another on both upper surface 64 and lower surface 66. Upper surface 64 includes tapered edge 70 and lower surface 66 includes tapered edge 72. Quick start seal member 18 is preferably fabricated from a food grade silane, siloxane, and/or silicone polymer and/or co-polymer. While specific polymeric materials have been disclosed as being preferred, numerous other materials that would be known to those having ordinary skill in the art having the present disclosure before them are likewise contemplated for use.

In operation and in one embodiment of the present invention, fill valve assembly 10 is positionable among four distinct positions, namely: (1) a closed position (See FIG. 6B); (2) a first open position wherein the quick start seal member contacts an upper wall of the valve housing (See FIG. 7B); (3) a second open position wherein the quick start seal member contacts a lower displacement stop member of the vent tube (See FIG. 8B); and (4) a CIP position (See FIG. 9B).

Figure 6A:
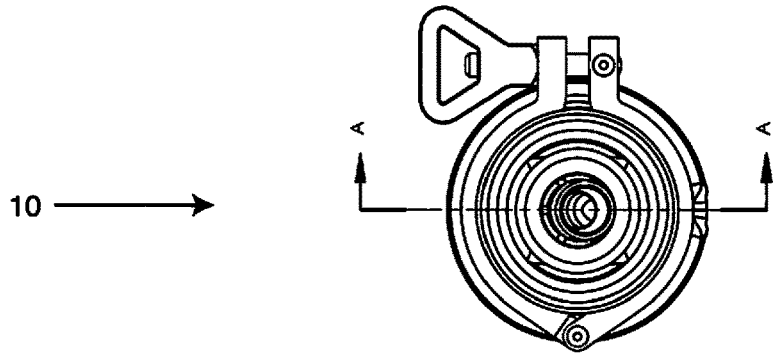
FIG. 6A of the drawings is a top plan view of a fill valve assembly fabricated in accordance with the present invention.
Figure 6B:
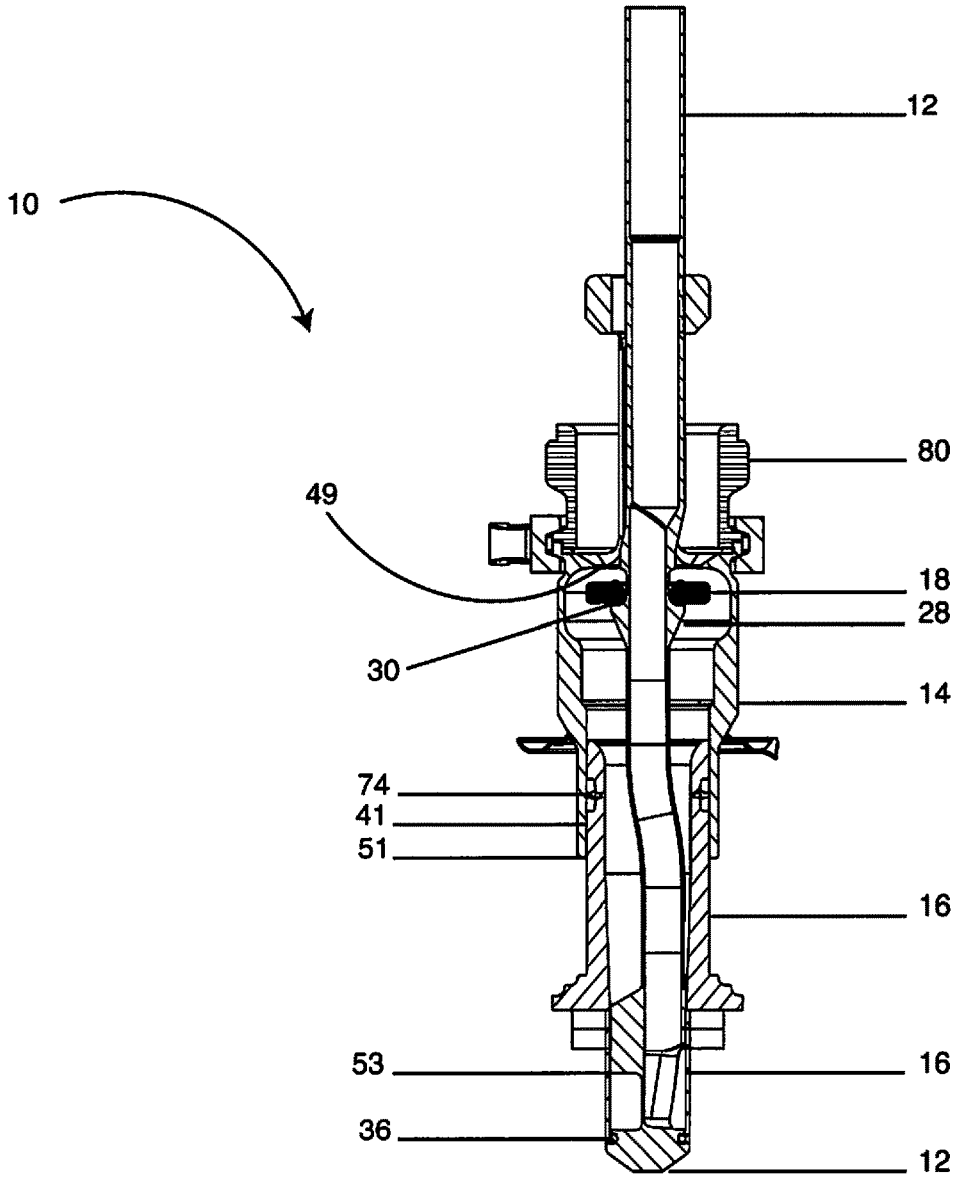
FIG. 6B of the drawings is a cross-sectional view of the fill valve assembly of FIG. 6A taken along line A-A, showing among other things, the fill valve assembly in a closed position.

As is shown in FIGS. 6A and 6B, the closed position precludes product from being dispensed. In this position, quick start seal member 18 is open, intermediate seal member 74 is closed, and lower seal member 36 is closed. More specifically, when fill valve assembly 10 is in the closed position: (1) protrusions 68 associated with lower surface 66 (See FIGS. 5A and 5B) of quick start seal member 18 contact annular upper surface 30 of stop member 28 of vent tube 12; (2) intermediate seal member 74 sealingly engages outer surface 51 of valve sleeve 16 and inner surface 41 of valve housing 14; and (3) lower seal member 36 sealingly engages the lower end of vent tube 12 and inner surface 53 lower end 52 of valve sleeve 16.

Figure 6C:
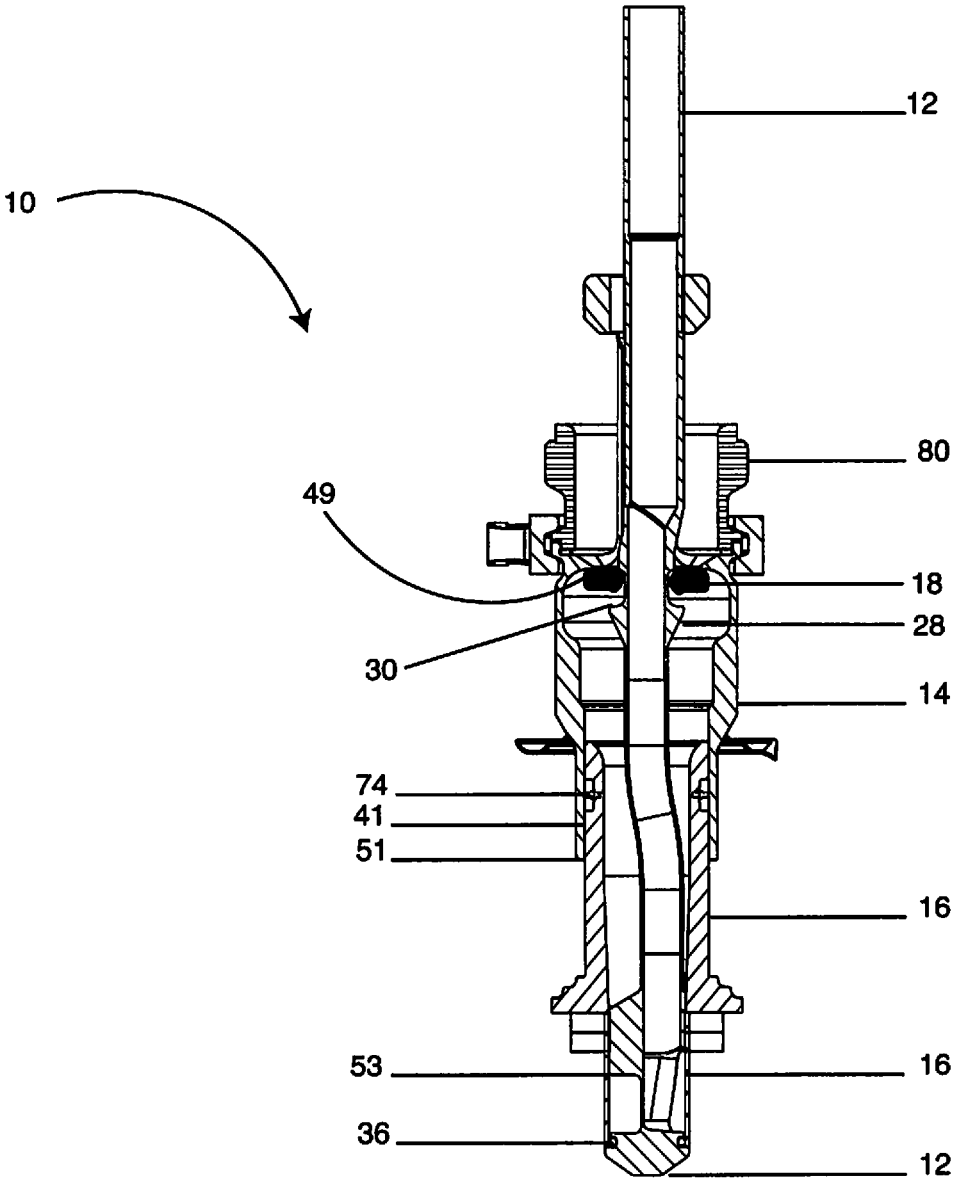
FIG. 6C of the drawings is a cross-sectional view of the fill valve assembly of FIG. 6A taken along line A-A, showing among other things, the fill valve assembly in a closed position wherein the quick start seal member comprises a density less than that of the fill material or product that it is filling, and, as such, contacts the inner top surface of the valve housing.

In an alternative embodiment of the present invention, the performance of quick start fill valve assembly 10 can be further enhanced if, in many cases, quick start seal member 18 comprises a density less than that of the fill material or product that it is filling. As is best shown in FIG. 6C, it will be understood that in this embodiment, quick start seal member 18 floats and/or rises up to and contacts inner top surface 49 of valve housing 14 even when quick start fill valve assembly 10 is in the closed position. It will be further understood that displacement and/or vertical movement of valve sleeve 16 is not required to raise and seal quick start seal member 18 because, in this embodiment, it is already properly positioned against inner top surface 49 of valve housing 14 due to its lighter density differential relative to the fill material or product.

Figure 7A:
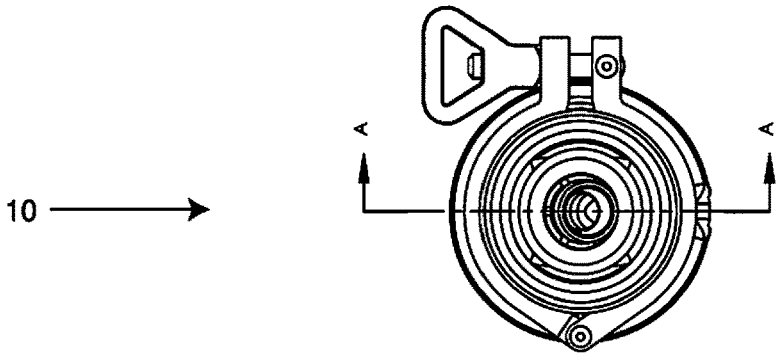
FIG. 7A of the drawings is a top plan view of a fill valve assembly fabricated in accordance with the present invention.
Figure 7B:
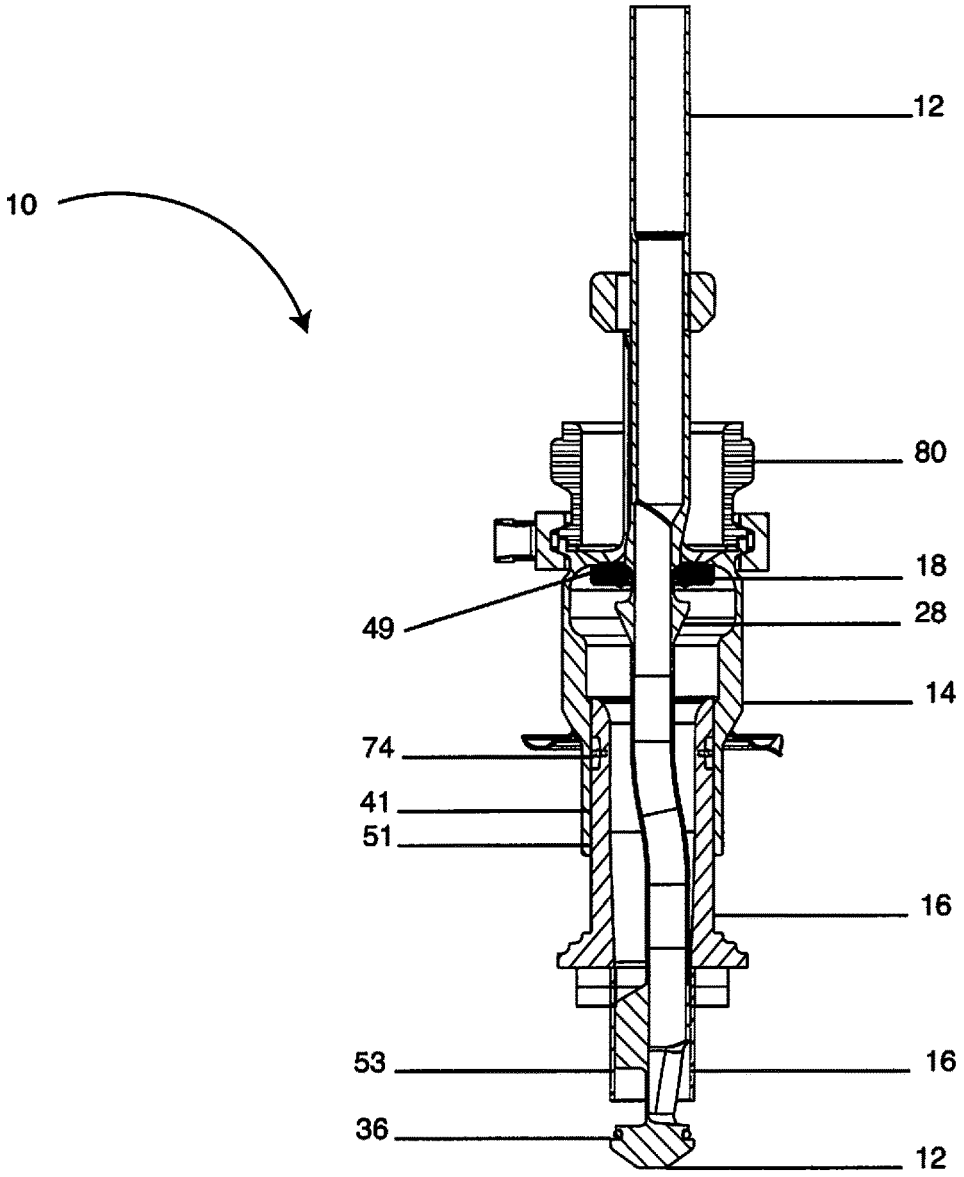
FIG. 7B of the drawings is a cross-sectional view of the fill valve assembly of FIG. 7A taken along line A-A, showing among other things, the fill valve assembly in a first open position.
Figure 8A:
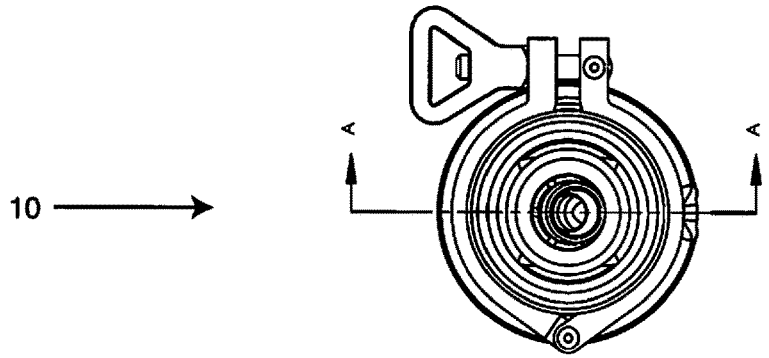
FIG. 8A of the drawings is a top plan view of a fill valve assembly fabricated in accordance with the present invention.
Figure 8B:
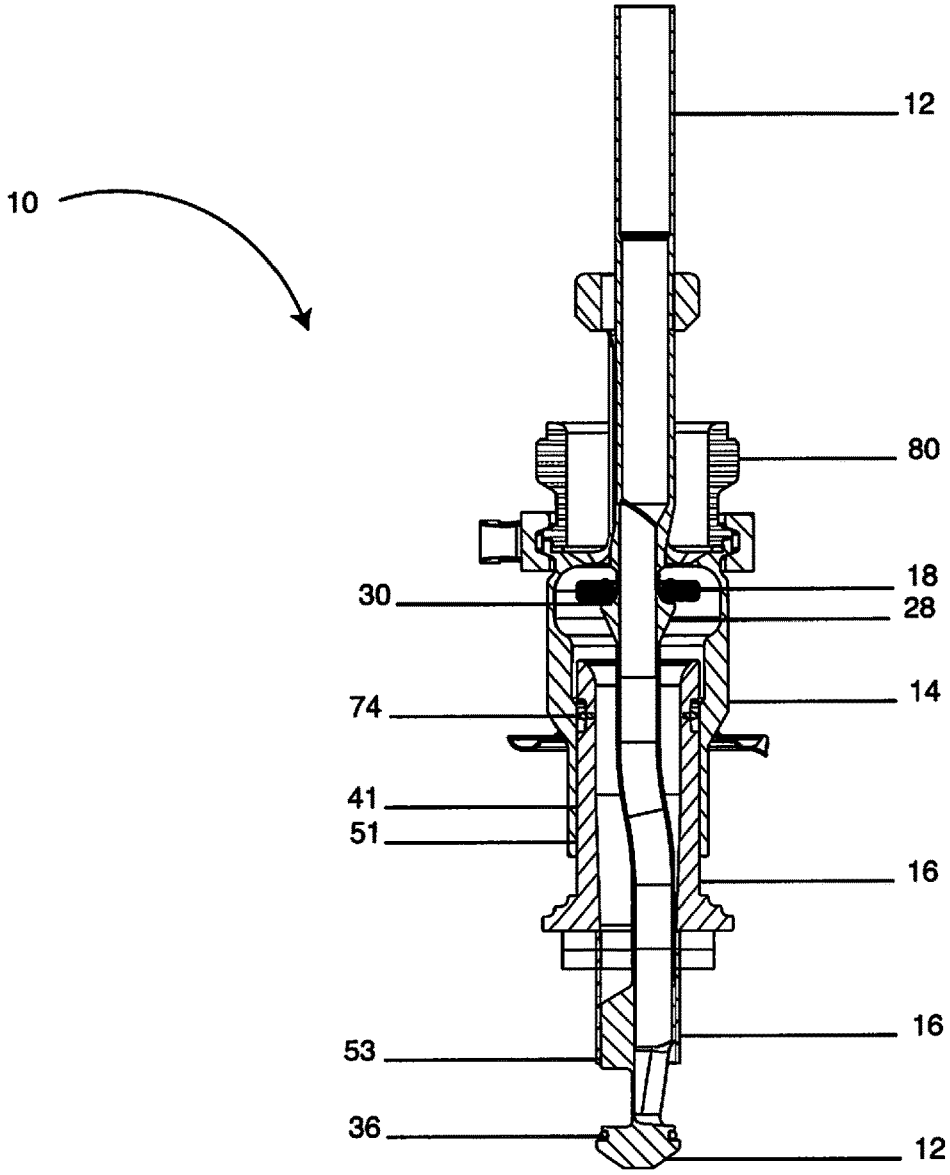
FIG. 8B of the drawings is a cross-sectional view of the fill valve assembly of FIG. 8A taken along line A-A, showing among other things, the fill valve assembly in a second open position.

As is shown in FIGS. 7A and 7B, upon actuation via cam or other displacement means, the first open position precludes or substantially precludes any filling start lag or pause. In this position, quick start seal member 18 is temporarily closed, intermediate seal member 74 is closed, and lower seal member 36 is open. More specifically, when fill valve assembly 10 is in the first open position: (1) protrusions 68 associated with upper surface 64 (See FIGS. 5A and 5B) of quick start seal member 18 contact inner top surface 49 of valve housing 14; (2) intermediate seal member 74 sealingly engages outer surface 51 of valve sleeve 16 and inner surface 41 of valve housing 14; and (3) lower seal member 36 disengages the seal between lower end 22 of vent tube 12 and inner surface 53 of lower end 52 of valve sleeve 16. Without being bound by any one particular theory, it is believed that first open position precludes or substantially precludes any filling start lag because as valve sleeve 16 rises, so does quick start seal member 18. This occurs because vent tube 12 is full of fluid, and fluid cannot flow into the associated sealed container (sealed from the atmosphere) until some air flows out of the container. Therefore, hydraulic compression of the fluid in the valve sleeve cavity, being non-compressible, lifts quick start seal member 18 up until it contacts upper inside surface 49 of valve adaptor 14. At this point, fluid from the filler bowl cannot begin to flow down in the bottle as its path is blocked. Now, further rise of the valve sleeve causes the fluid trying to be compressed to flow out the valve nozzle into the container. Since the mouth of the container is sealed from the outside atmosphere, air inside the container begins to be compressed and build up a pressure that can only escape thru the vent tube that is full of liquid from the previous container. This buildup of "back pressure" from the valve sleeve rising, forces the liquid in the vent tube to move vertically up and out through vent aperture 26. When the valve sleeve is finished rising, vent tube 12 has been cleaned of fluid so that previously trapped air can now flow upward and fluid can then begin to flow downward from above out just above lower seal member 36 and into the container. The moment fluid begins to flow down, quick start seal member 18 also moves down and repositions itself on annular upper surface 30 of stop member 28 of vent tube 12. During this time, intermediate seal member 74 is closed and lower seal member 36 is open. (See FIGS. 8A and 8B).

More specifically, when fill valve assembly 10 is in the second open position: (1) protrusions 68 associated with lower surface 66 (See FIGS. 5A and 5B) of quick start seal member 18 contact annular upper surface 30 of stop member 28 of vent tube 12; (2) intermediate seal member 74 sealingly engages outer surface 51 of valve sleeve 16 and inner surface 41 of valve housing 14; and (3) lower seal member 36 disengages the lower end of vent tube 12 and inner surface 53 lower end 52 of valve sleeve 16. This second open position does not require further vertical movement of valve sleeve 16 as downward fluid flow provides the energy necessary to reposition quick start seal member 18 back on to annular upper surface 30 of stop member 28 of vent tube 12.

Figure 9A:
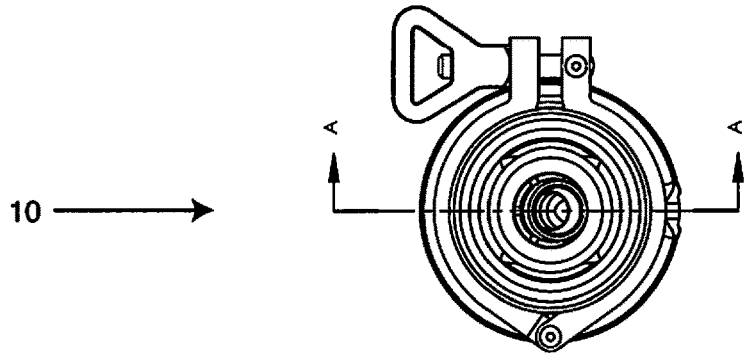
FIG. 9A of the drawings is a top plan view of a fill valve assembly fabricated in accordance with the present invention.
Figure 9B:
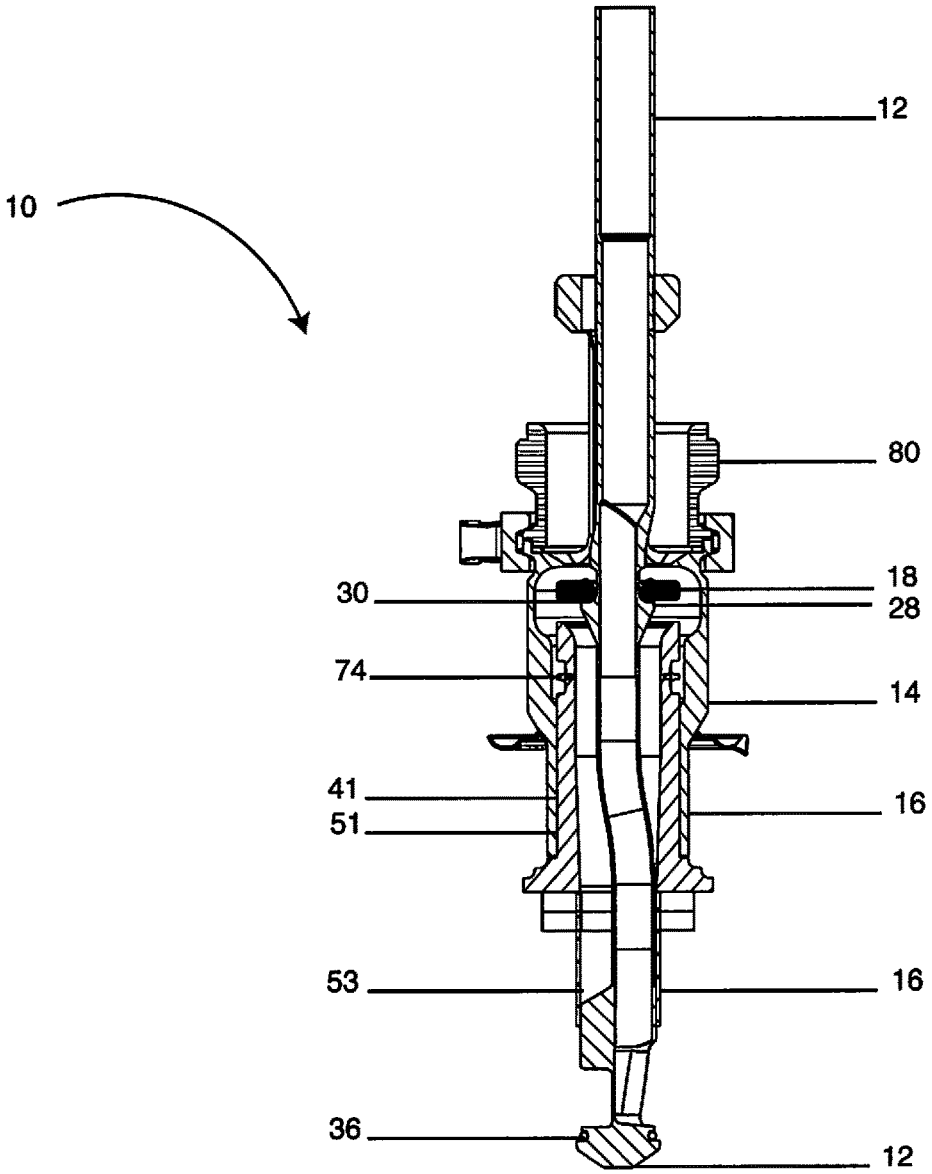
FIG. 9B of the drawings is a cross-sectional view of the fill valve assembly of FIG. 9A taken along line A-A, showing among other things, the fill valve assembly in a CIP position.

As is shown in FIGS. 9A and 9B, upon further actuation via cam or other displacement means, the CIP position allows for cleansing of the fill valve assembly without disassembly. In this position, quick start seal member 18 is open or unobstructive, intermediate seal member 74 is open, and lower seal member 36 is open. More specifically, when fill valve assembly 10 is in the CIP position: (1) protrusions 68 associated with lower surface 66 (See FIGS. 5A and 5B) of quick start seal member 18 contact annular upper surface 30 of stop member 28 of vent tube 12; (2) intermediate seal member 74 disengages a portion of outer surface 51 of valve sleeve 16 and inner surface 41 of valve housing 14; and (3) lower seal member 36 disengages the lower end of vent tube 12 and inner surface 53 lower end 52 of valve sleeve 16.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A fill valve assembly for use in association with a filler device, comprising:

a vent tube, a valve housing, a valve sleeve, and a seal member;

wherein the vent tube comprises an upper venting aperture, a lower venting aperture, an intermediate region having a lower displacement stop member having an annular upper surface, wherein the lower displacement stop member comprises an outer diameter greater than an outer diameter of the vent tube positioned immediately below the lower displacement stop member, and wherein the vent tube is positioned at least partially within the valve housing, and the valve sleeve:

wherein the valve housing is in communication with a filler device;

wherein the valve sleeve is positioned at least partially within the valve housing;

wherein the seal member is positioned within the valve housing;

wherein the fill valve assembly is positionable among a closed position, a first open position, a second open position, and a clean-in-place position;

wherein when the fill valve assembly is in a first open position, the seal member contacts an upper wall of the valve housing, and when the fill valve assembly is in a second open position, the seal member contacts the lower displacement stop member of the vent tube; and wherein the seal member is configured such that moving the valve sleeve relative to the valve housing causes the seal member to displace upwardly relative to the vent tube and the displacement stop member from the second open position to the first open position.

* * * * *